US008684699B2

(12) United States Patent
Nathan et al.

(10) Patent No.: US 8,684,699 B2
(45) Date of Patent: Apr. 1, 2014

(54) PUMP FOR A HIGH-PRESSURE CLEANING APPLIANCE

(75) Inventors: Robert Nathan, Backnang (DE); Juergen Erdmann, Schorndorf-Weiler (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/425,486

(22) Filed: Mar. 21, 2012

(65) Prior Publication Data

US 2012/0211034 A1 Aug. 23, 2012

Related U.S. Application Data

(63) Continuation of application No. PCT/EP2010/064162, filed on Sep. 24, 2010.

(30) Foreign Application Priority Data

Oct. 1, 2009 (DE) ..... 10 2009 049 094

(51) Int. Cl.
*F04B 49/22* (2006.01)
*F04B 1/26* (2006.01)

(52) U.S. Cl.
USPC ..... 417/28; 417/43; 417/270; 417/300

(58) Field of Classification Search
USPC ..... 417/26, 28, 43, 300, 307, 270
See application file for complete search history.

(56) References Cited

U.S. PATENT DOCUMENTS

| | | | | | |
|---|---|---|---|---|---|
| 2,018,119 | A | * | 10/1935 | Brouse | 417/282 |
| 2,562,615 | A | * | 7/1951 | Huber | 417/289 |
| 2,806,430 | A | * | 9/1957 | Osborne | 137/115.07 |
| 3,018,737 | A | * | 1/1962 | Cook et al. | 74/60 |
| 3,362,335 | A | | 1/1968 | Stephens et al. | |
| 3,754,842 | A | * | 8/1973 | Schlanzky | 417/269 |
| 4,692,102 | A | | 9/1987 | Häfele et al. | |
| 4,784,368 | A | * | 11/1988 | Koch et al. | 251/51 |
| 5,013,219 | A | * | 5/1991 | Hicks et al. | 417/269 |
| 5,259,556 | A | | 11/1993 | Paige et al. | |
| 5,397,054 | A | * | 3/1995 | Ziegs | 239/126 |
| 5,409,032 | A | | 4/1995 | Berfield | |
| 5,735,461 | A | * | 4/1998 | Winther | 239/124 |

(Continued)

FOREIGN PATENT DOCUMENTS

| | | |
|---|---|---|
| CN | 2694014 | 4/2005 |
| DE | 27 05 585 | 8/1977 |

(Continued)

*Primary Examiner* — Charles Freay
(74) *Attorney, Agent, or Firm* — Lipsitz & McAllister, LLC

(57) ABSTRACT

A pump for a high-pressure cleaning appliance for delivering cleaning liquid is provided. The pump has a pump housing with at least one pump chamber into which at least one piston plunges. The pump chamber is connected via at least one inlet valve to a suction line and via at least one outlet valve to a pressure line. A bypass line leads from the pressure line to the suction line. An overflow valve is arranged in the bypass line. The valve body of the overflow valve is connected to a control element which, in dependence upon the flow rate of the cleaning liquid, displaces the valve body to a closed or an open position. A rear housing component and a front housing component of the pump housing are joined together. The bypass line opens into a suction line section of the suction line, which extends between the housing components.

13 Claims, 5 Drawing Sheets

(56) References Cited

U.S. PATENT DOCUMENTS

| | | | | |
|---|---|---|---|---|
| 5,950,669 | A | 9/1999 | Fehlmann et al. | |
| 6,474,958 | B2 * | 11/2002 | Nathan | 417/269 |
| 6,497,247 | B1 | 12/2002 | Kinoshita et al. | |
| 6,866,483 | B2 * | 3/2005 | Pol | 417/43 |
| 2007/0267063 | A1 | 11/2007 | Davis | |
| 2010/0059603 | A1 | 3/2010 | Mueller et al. | |

FOREIGN PATENT DOCUMENTS

| | | |
|---|---|---|
| DE | 32 48 622 | 7/1984 |
| DE | 85 14 497 | 8/1985 |
| DE | 36 34 827 | 4/1988 |
| DE | 39 36 155 | 5/1991 |
| DE | 42 21 286 | 1/1993 |
| DE | 93 01 796 | 5/1993 |
| DE | 43 28 382 | 3/1994 |
| DE | 44 45 519 | 6/1996 |
| DE | 296 11 935 | 10/1996 |
| DE | 297 03 009 | 6/1997 |
| DE | 196 07 881 | 9/1997 |
| DE | 196 17 778 | 10/1997 |
| DE | 297 12 659 | 10/1997 |
| DE | 197 28 225 | 1/1999 |
| DE | 696 02 551 | 9/1999 |
| DE | 10 2007 017 970 | 10/2008 |
| DE | 10 2008 059 782 | 6/2009 |
| EP | 0 608 796 | 8/1994 |
| EP | 0 631 054 | 12/1994 |
| EP | 0 668 113 | 8/1995 |
| EP | 44 04 925 | 8/1995 |
| EP | 0 793 017 | 9/1997 |
| EP | 1 234 980 | 8/2002 |
| EP | 1 496 252 | 1/2005 |
| FR | 2 341 087 | 9/1977 |
| JP | 2006207833 | 8/2006 |

* cited by examiner

PUMP FOR A HIGH-PRESSURE CLEANING APPLIANCE

This application is a continuation of international application number PCT/EP2010/064162 filed on Sep. 24, 2010 and claims the benefit of German application number 10 2009 049 094.9 filed on Oct. 1, 2009.

The present disclosure relates to the subject matter disclosed in international application number PCT/EP2010/064162 of Sep. 24, 2010 and German application number 10 2009 049 094.9 of Oct. 1, 2009, which are incorporated herein by reference in their entirety and for all purposes.

BACKGROUND OF THE INVENTION

The invention relates to a pump for a high-pressure cleaning appliance for delivering a cleaning liquid, comprising a pump housing in which is arranged at least one pump chamber into which at least one piston which is movable back and forth plunges, and which is connected via at least one inlet valve to a suction line and via at least one outlet valve to a pressure line, and comprising a bypass line which leads from the pressure line to the suction line, and in which is arranged an overflow valve, the valve body of which is connected to a control element which in dependence upon the flow rate of the cleaning liquid in the pressure line displaces the valve body to a closed position or an open position.

Such pumps are known from DE 93 01 796 U1. They can be used to subject a cleaning liquid, for example, water to pressure and to then direct it at an object, for example, via a pressure hose connectable to the pressure line and a nozzle head arranged at the free end of the pressure hose. In order that continued operation of the pump, with the nozzle head closed, will not lead to a continuing high pressure in the pressure line, resulting in considerable power consumption of the pump and substantial heat losses, the cleaning liquid conveyed by the pump is usually recirculated with as low a flow resistance as possible, i.e., it is fed back from the pressure line to the suction line again. For this purpose, the pressure line is connected to the suction line by a bypass line, and an overflow valve is arranged in the bypass line. During working operation of the pump, i.e., when the nozzle head is open, the overflow valve closes the flow connection between the pressure line and the suction line. During circuit operation, i.e., when the nozzle head is closed, the overflow valve opens the flow connection between the pressure line and the suction line. The overflow valve comprises a valve body, which is connected to a control element. In dependence upon the flow rate of the cleaning liquid in the pressure line, the control element displaces the valve body to a closed position or an open position. The flow rate of the cleaning liquid in the pressure line depends on whether the nozzle head is open or closed. If the nozzle head is closed, the flow rate drops, and this causes the control element to displace the valve body of the overflow valve to its open position, with the result that the pump then transfers to circuit operation. If the nozzle head is opened, the flow rate in the pressure line rises and this causes the control element to displace the valve body of the overflow valve to the closed position, with the result that the pump transfers to working operation.

In order that such pumps will have as low a weight as possible for easier handling, a compact structural size is chosen for the pumps. However, this leads to cramped space conditions in the pump housing. The provision of the individual lines and spaces for accommodating valves therefore often proves difficult in terms of manufacture and involves considerable costs.

The object of the present invention is to further develop a pump of the kind mentioned at the outset so that it can be produced at lower cost and more easily in terms of manufacturing technology.

SUMMARY OF THE INVENTION

This object is accomplished, in accordance with the invention, in a pump for a high-pressure cleaning appliance of the generic kind in that the pump housing comprises a rear housing component and a front housing component which are joined together, and in that the suction line comprises a suction line section which extends in the joining area between the two housing components, and into which the bypass line opens.

In accordance with the invention, the pump housing comprises a rear and a front housing component. The rear housing component faces a drive device of the pump, for example, an electric motor, and a gearing and/or a swash plate and a piston guide may be arranged between the electric motor and the rear housing component. The front housing component is seated on the rear housing component and faces away from the drive device of the pump. In the joining area between the two housing components, i.e., in the area in which the two housing components rest tightly against each other, there is arranged, in accordance with the present invention, a suction line section. This suction line section can be easily manufactured at low cost before joining the two housing components, and this, in turn, lowers the manufacturing costs of the pump.

The arrangement of a suction line section in the joining area between the front and the rear housing components of the pump housing also has the advantage that the geometrical configuration of the suction line section is subject to fewer constraints, because the joining area is directly accessible for machining and shaping prior to joining of the two housing components. Therefore, if required, a curved configuration may also be chosen for the suction line section arranged between the two housing components without the manufacturing costs thereby being considerably increased. This, in turn, enables the designer to optimize arrangement of the other lines and accommodating spaces in the pump housing with regard to as small a structural size as possible and use of as little material as possible. The pump in accordance with the invention is therefore particularly well suited for portable high-pressure cleaning appliances of relatively low weight.

The suction line section extending between the two housing components can be sealed in a cost-effective manner by sealing rings which are arranged between the two housing components.

In particular, it may be provided that the suction line section arranged between the two housing components extends between a first sealing ring and a second sealing ring, which are positioned between the two housing components. The two sealing rings may not only assume the function of tightly sealing the suction line section arranged between the two housing components, but may also assume the function of sealing the joining area between the two housing components.

It is advantageous if the suction line section extending between the two housing components forms an outlet section of the suction line. At least one inlet line, which accommodates an input valve and leads to a pump chamber, can be connected to the outlet section.

The suction line advantageously comprises an inlet section arranged in the front housing component, and the suction line section extending in the joining area between the two housing components forms an outlet section of the suction line. The inlet section may start from a suction connection of the pump and, for example, be oriented transversely to the pressure line. The outlet section arranged between the housing components may be directly connected to the inlet section.

It is advantageous if the suction line section extending in the joining area is arcuately curved at least in a portion thereof. The arcuate curvature is advantageous, in particular, in view of the cramped space conditions in the pump housing, as the suction line section can thereby bypass accommodating spaces for the inlet and outlet valves and for the control element and, if required, also the pressure line. Above all, a circular arc-shaped configuration of the suction line section arranged in the joining area has proven advantageous.

In a particularly preferred embodiment of the pump in accordance with the invention, the suction line section extending in the joining area is configured as a self-contained ring. In such an embodiment, there can extend in the joining area between the rear housing component and the front housing component an annular space, which forms the aforementioned suction line section. This annular space may have a relatively large flow cross section, so that the cleaning liquid to be delivered can be fed to the at least one pump chamber with low flow resistance.

The front housing component of the pump housing comprises a rear-side separating surface which is placed on a front-side separating surface of the rear housing component with at least one sealing element interposed between these. There is preferably formed in at least one of the separating surfaces a channel which constitutes at least a portion of the suction line section arranged in the joining area between the two housing components. The channel is arranged on an outer side of at least one of the housing components and, consequently, can be produced very cost-effectively.

It is advantageous if there is formed in the rear-side separating surface of the front housing component a channel which is covered by the front-side separating surface of the rear housing component and constitutes the suction line section arranged in the joining area between the two housing components.

Alternatively, it may, for example, be provided that there is formed in the front-side separating surface of the rear housing component a channel which is covered by the rear-side separating surface of the front housing component and constitutes the suction line section.

In an advantageous embodiment, the suction line section extending in the joining area between the two housing components surrounds the pressure line at a distance therefrom. In particular, it may be provided that the suction line section extending in the joining area surrounds the pressure line in the shape of a ring.

In an advantageous embodiment of the invention, the control element is configured as a control piston which divides a control chamber of the front housing component into a low-pressure chamber and a high-pressure chamber, is displaceable in the control chamber and is connected by a piston rod to the valve body of the overflow valve, the low-pressure chamber being connected by a control line downstream of a throttle point to the pressure line, and the high-pressure chamber being connected to the pressure line by a portion of the bypass line that is arranged upstream of the overflow valve. In such an embodiment, there is arranged in the pressure line of the pump a throttle point, for example, an injector, by means of which a cleaning chemical can be drawn in and mixed with the pressurized cleaning liquid. When there is a flow of liquid in the pressure line, the consequence of the throttle point is that the pressure downstream of the throttle point differs from the pressure upstream of the throttle point. As the low-pressure chamber is connected by the control line downstream of the throttle point to the pressure line, whereas the high-pressure chamber is connected upstream of the throttle point by a portion of the bypass line to the pressure line, the control piston is acted upon by a differential pressure when there is a flow of liquid through the pressure line. Owing to the differential pressure acting upon it, the control piston displaces the valve body of the overflow valve against the direction of flow prevailing in the bypass line to a closed position. If the flow of liquid is interrupted, then the throttle point does not cause any drop in pressure and the pressure in the low-pressure chamber corresponds to the pressure in the high-pressure chamber. In the absence of a differential pressure between the two chambers, the control piston can be acted upon with a resulting force dependent upon the areas exposed to pressure of the two chambers, by which it undergoes such displacement in the control chamber that the valve body connected to it transfers to an open position and, consequently, opens the flow connection between the pressure line and the suction line for circuit operation of the pump.

The movement of the control piston is transmitted through the piston rod onto the valve body. The control piston is preferably displaceable parallel to the pressure line, and the piston rod is oriented parallel to the pressure line.

The piston rod by which the valve body of the overflow valve is connected to the control piston preferably forms on the side of the valve body that faces away from the control piston a plunger for actuating a switch element. The control piston can therefore be used not only to displace the valve body of the overflow valve but also to actuate a switch element. The switch element may, for example, switch on and off a drive device of the pump, preferably an electric motor. The pump can therefore be activated and deactivated by actuating the plunger. If, in such a construction, the flow of liquid in the pressure line is interrupted, then, firstly, the overflow valve opens the flow connection between the pressure line and the suction line, with the result that the pressure prevailing in the pressure line can be reduced, and, secondly, the pump is switched off. Operation of the pump is resumed when the flow of liquid in the pressure line is enabled again by opening the nozzle head connected to the pressure line as the pressure in the low-pressure chamber thereby drops, the consequence of which is that the control piston is displaced. This, in turn, firstly, has the consequence that the flow connection between the pressure line and the suction line is interrupted again, and, secondly, it has the consequence that the pump is switched on again.

In an advantageous embodiment of the invention, the valve body of the overflow valve is configured as a radial widening of the piston rod. This makes it possible to manufacture the valve body particularly cost-effectively.

In a preferred embodiment of the invention, the plunger sinks into a receptacle which is formed in the rear housing component, and in which the switch element is arranged. The plunger therefore passes through the joining area between the two housing components.

It is particularly advantageous if the bypass line comprises a portion which accommodates the overflow valve, opens into the suction line section extending in the joining area between the two housing components and is oriented in alignment with the control chamber. The aforementioned portion of the bypass line can be directly connected to the control chamber.

The control chamber and the portion of the bypass line that accommodates the overflow valve are advantageously oriented parallel to the pressure line.

In an advantageous embodiment of the pump in accordance with the invention, the control chamber and the portion of the bypass line that accommodates the overflow valve are arranged in a through-channel which passes through the front housing component from a front end side to a rear-side separating surface.

The longitudinal axis of the through-channel preferably extends parallel to the pressure line.

The following description of a preferred embodiment of the invention serves in conjunction with the drawings for a more detailed explanation.

DETAILED DESCRIPTION OF THE INVENTION

Figure 3:
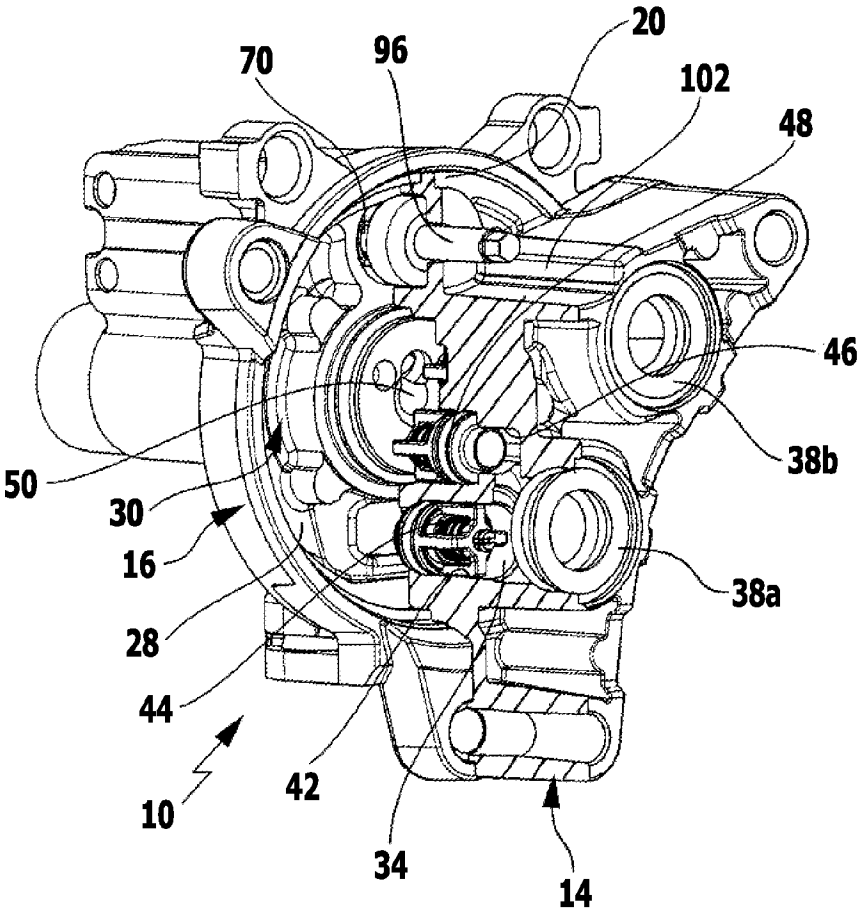
FIG. 3 shows a perspective illustration, partially sectional in a rear housing component, of the pump from FIG. 1 at an angle from behind.

A pump 10 for a high-pressure cleaning appliance is schematically illustrated in the drawings. The pump 10 comprises a pump housing 12 with a rear housing component 14 and a front housing component 16. The two housing components preferably take the form of aluminum die-castings. The front housing component 16 is provided with a rear-side separating surface 20, which is placed on a front-side separating surface 22 of the rear housing component 14 with an outer sealing ring 24 and an inner sealing ring 26 interposed between these. The two sealing rings 24 and 26 are arranged concentrically with each other at the outer and the inner edge, respectively, of a ring channel 28 formed in the rear-side separating surface 20 of the front housing component 16. The ring channel 28 will be particularly clear from FIG. 3. It forms an outlet section 30 of a suction line, the inlet section 32 of which is formed as a blind hole in the front housing component 16.

The rear housing component 14 accommodates pump chambers 34, into each of which a cylindrical piston 36*a* or 36*b* plunges. The pistons 36*a*, 36*b* are sealed off from the respective pump chamber 34 by a lip-shaped ring seal 38*a* and 38*b*, respectively. The rear housing component 14 comprises a total of three pump chambers, into each of which a piston plunges. For a better overview, only one pump chamber 34 and two pistons 36*a* and 36*b* are illustrated in the drawings. All of the pistons are pushed oscillatingly into the respective pump chamber 34 by a swash plate known per se, not illustrated in the drawings, and pulled out of the pump chamber again by a helical spring 40 surrounding the respective piston, with the result that the volume of the pump chambers 34 changes periodically.

Each pump chamber 34 is in flow connection with the ring-shaped outlet section 30 of the suction line via an inlet line 42 in which an inlet valve 44 is installed. For this purpose, the inlet line 42 opens into the front-side separating surface 22 of the rear housing component 14. This will be clear, for example, from FIG. 2.

Each pump chamber 34 is in flow connection with a pressure line 50 formed in the front housing component 16 and extending in the longitudinal direction of the pump 10 via an outlet line 46 in which an outlet valve 48 is installed. For this purpose, the outlet line 46 opens into the front-side separating surface 22 of the rear housing component, and the pressure line 50 starts from the rear-side separating surface 20 of the front housing component 16 and extends as far as a front side 52 of the front housing component 16 that faces away from the rear housing component 14. The front side 52 forms the front end of the pump 10. The region between the outlet lines 46 of the pump chambers 34 and the pressure line 50 is sealed off radially outwards by the outer sealing ring 26.

A central pressure valve 54 is arranged in the pressure line 50, and, downstream of the pressure valve 54, the pressure line 50 accommodates a throttle element in the form of an injector 56. The latter comprises in the usual manner a through-bore 58, which first narrows and then widens again in flow direction, and from the narrowest point of which a transverse bore 60 branches off.

A step-shaped through-channel 62 extends through the front housing component 16 from the front side 52 to the rear-side separating surface 20 parallel to the pressure line 50. The end region of the through-channel 62 at the front side accommodates a sealing plug 64 which tightly seals the through-channel 62 at the front side. In the region adjoining the sealing plug 64, the through-channel 62 defines a control chamber 66 which is adjoined via a step 68 by a lower portion 70 of a bypass line, explained in greater detail hereinbelow. The lower portion 70 accommodates an overflow valve 72 and opens into the ring channel 28 and hence into the outlet section 30 of the suction line, which is arranged in the joining area between the two housing components 14, 16.

The control chamber 66 is of cylindrical configuration and accommodates a slide sleeve 74 which rests against the wall of the control chamber 66 with a sealing ring 76 interposed between these. A control element in the form of a control piston 78 is held so as to be displaceable parallel to the longitudinal axis of the pressure line 50 in the slide sleeve 74. The control piston 78 divides the control chamber 66 up into a low-pressure chamber 80 facing the sealing plug 64 and a high-pressure chamber 82 facing away from the sealing plug 64. The high-pressure chamber 82 is adjoined by the lower portion 70 of the bypass line.

Figure 4:
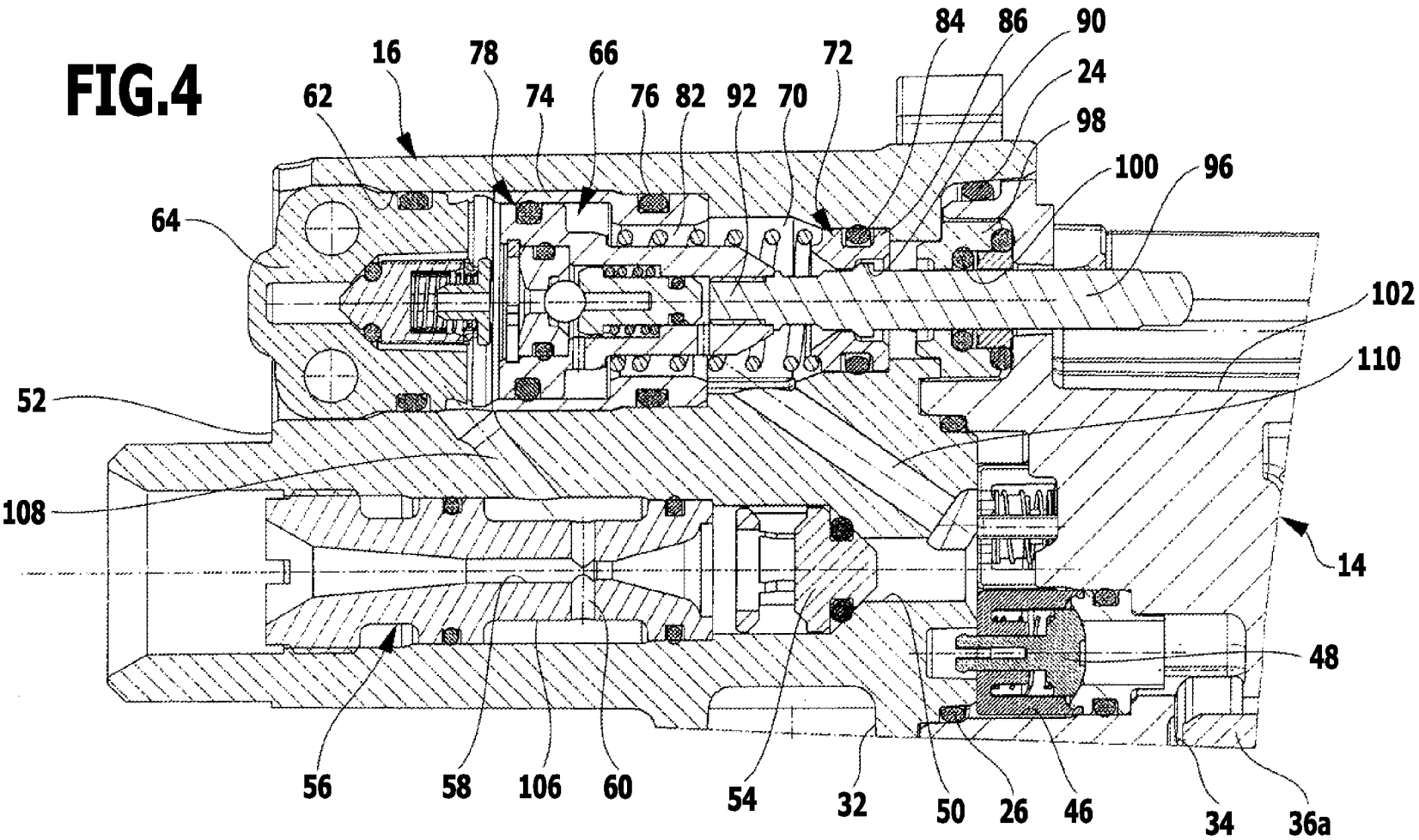
FIG. 4 shows an enlarged sectional illustration of the pump from FIG. 1 in the region of an overflow valve, the valve body of which assumes a closed position.
Figure 5:
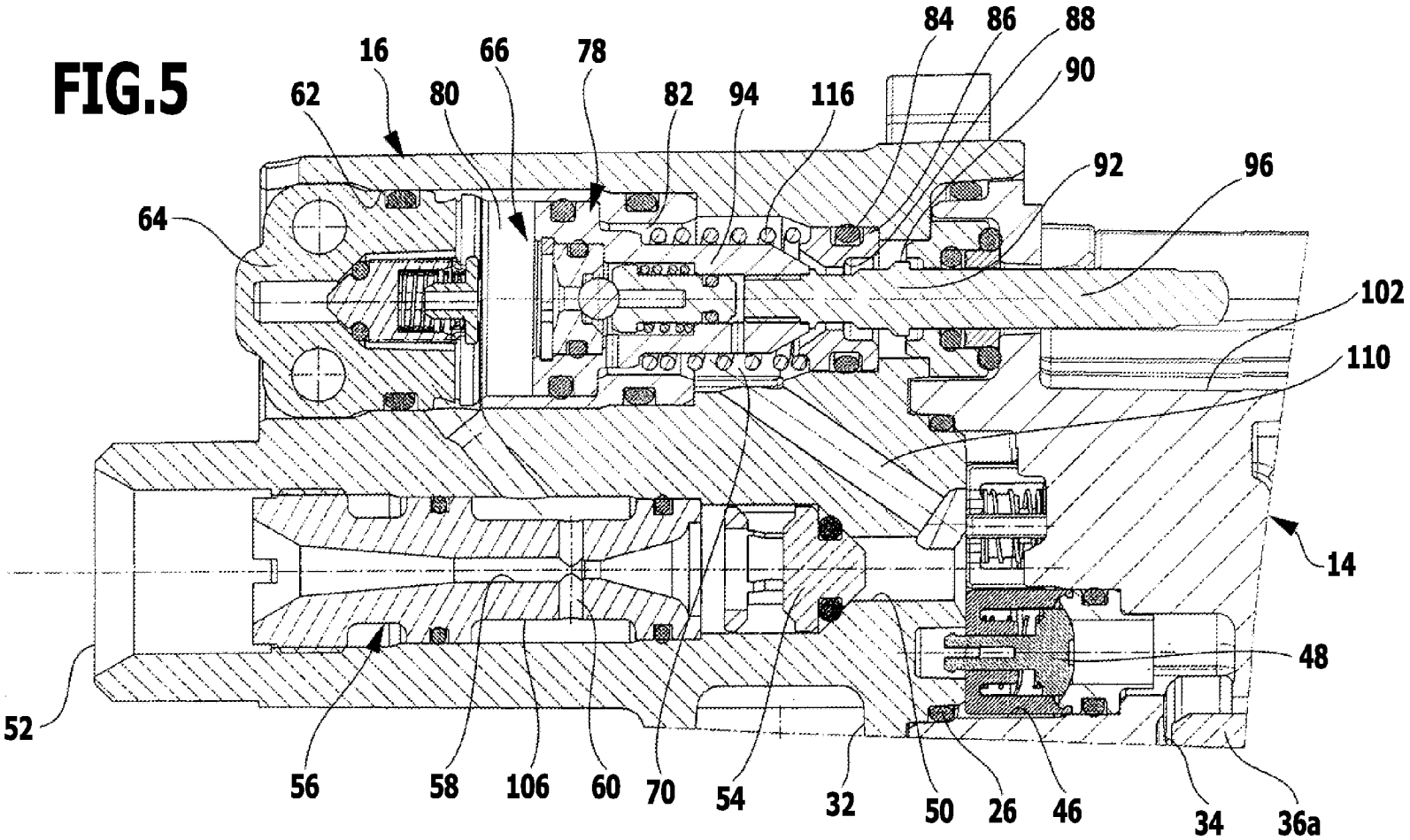
FIG. 5 shows an enlarged sectional illustration of the pump from FIG. 1 in the region of the overflow valve, the valve body of which assumes an open position.

A valve sleeve 86, which forms a valve seat 88 of the overflow valve 72, is installed in the lower portion 70 of the bypass line, with a sealing ring 84 interposed between these. In a closed position, which is shown in FIG. 4, a valve body 90 of the overflow valve 72 can be made to rest in a sealing manner against the valve seat 88. The valve body 90 is formed by a radial widening of a piston rod 92 which extends parallel to the longitudinal axis of the pressure line 50 and with its end that faces the sealing plug 64 is connected to a shaft 94 formed on the control piston 78.

On the side of the valve body 90 facing away from the shaft 94, the piston rod 92 forms a plunger 96 which is slidingly guided in a guide sleeve 98 with a sealing ring 100 interposed between these. The guide sleeve 98 is arranged in alignment with the valve sleeve 86 of the overflow valve 72 and at a distance from the valve sleeve 86 in the ring channel 28 of the rear-side separating surface 20 of the front housing component 16.

Figure 1:
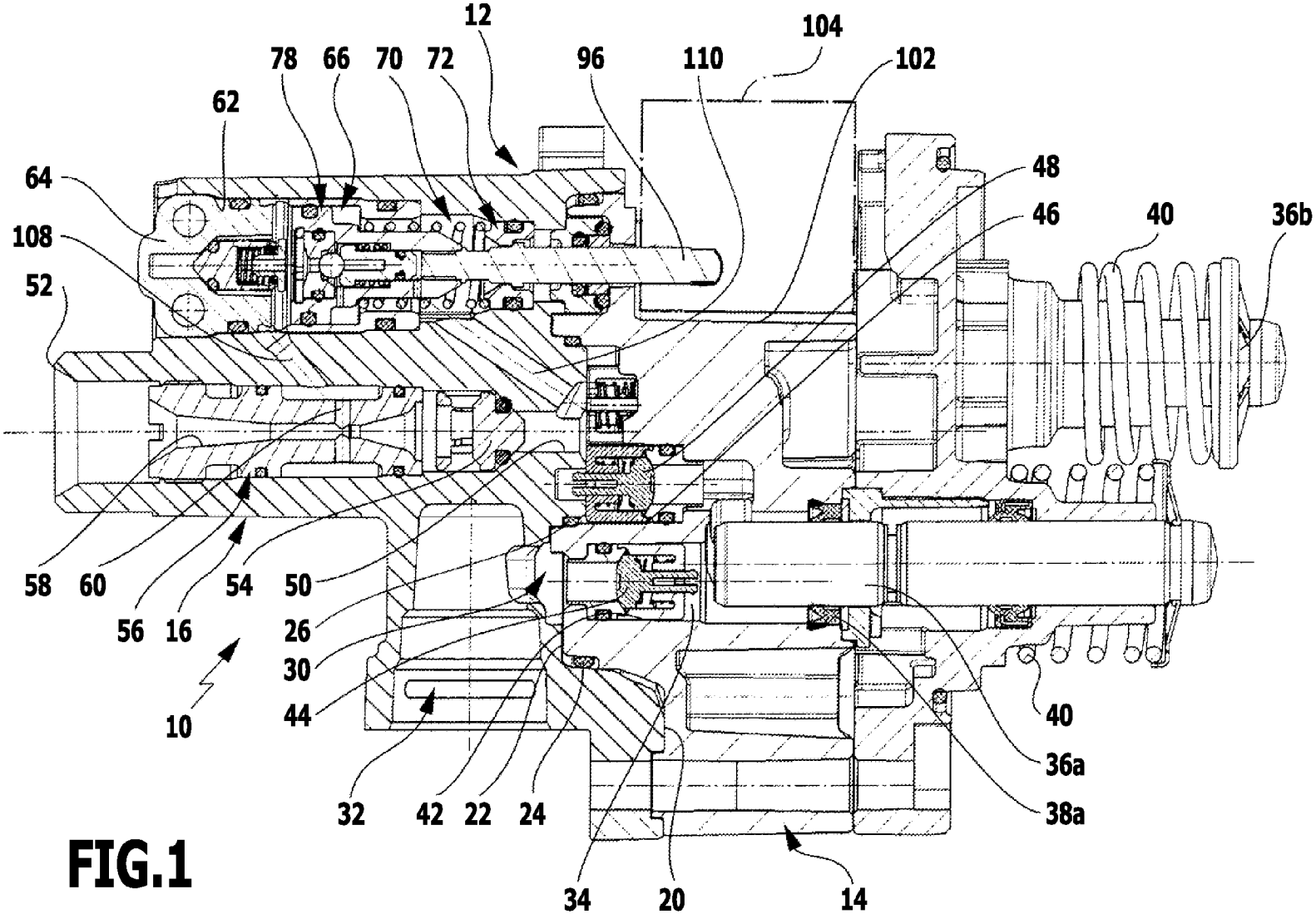
FIG. 1 shows a longitudinal section of a pump in accordance with the invention.

With its free end, the plunger 96 enters a receptacle 102, which is formed in the rear housing component 14 and accommodates a switch element 104, known per se and shown in dashed lines in FIG. 1, which can be actuated by the plunger 96. The plunger therefore passes through the joining area between the two housing components 14 and 16.

The injector 56 arranged in the pressure line 50 comprises on its outer side a ring groove 106 into which the transverse bore 60 opens. Adjoining the ring groove 106 is a control line 108, via which the ring groove 106 is in flow connection with the low-pressure chamber 80.

An upper portion 110 of the bypass line extends upstream of the injector 56 and the central pressure valve 54 from the pressure line 50 to the high-pressure chamber 82. The aforementioned lower portion 70 of the bypass line adjoins the upper portion 110 in the through-channel 62. The bypass line formed by the two portions 70 and 110 therefore defines a flow connection between the pressure line 50 and the outlet section 30 of the suction line. This flow connection can be opened and closed in dependence upon the position of the valve body 90 of the overflow valve 72.

Figure 2:
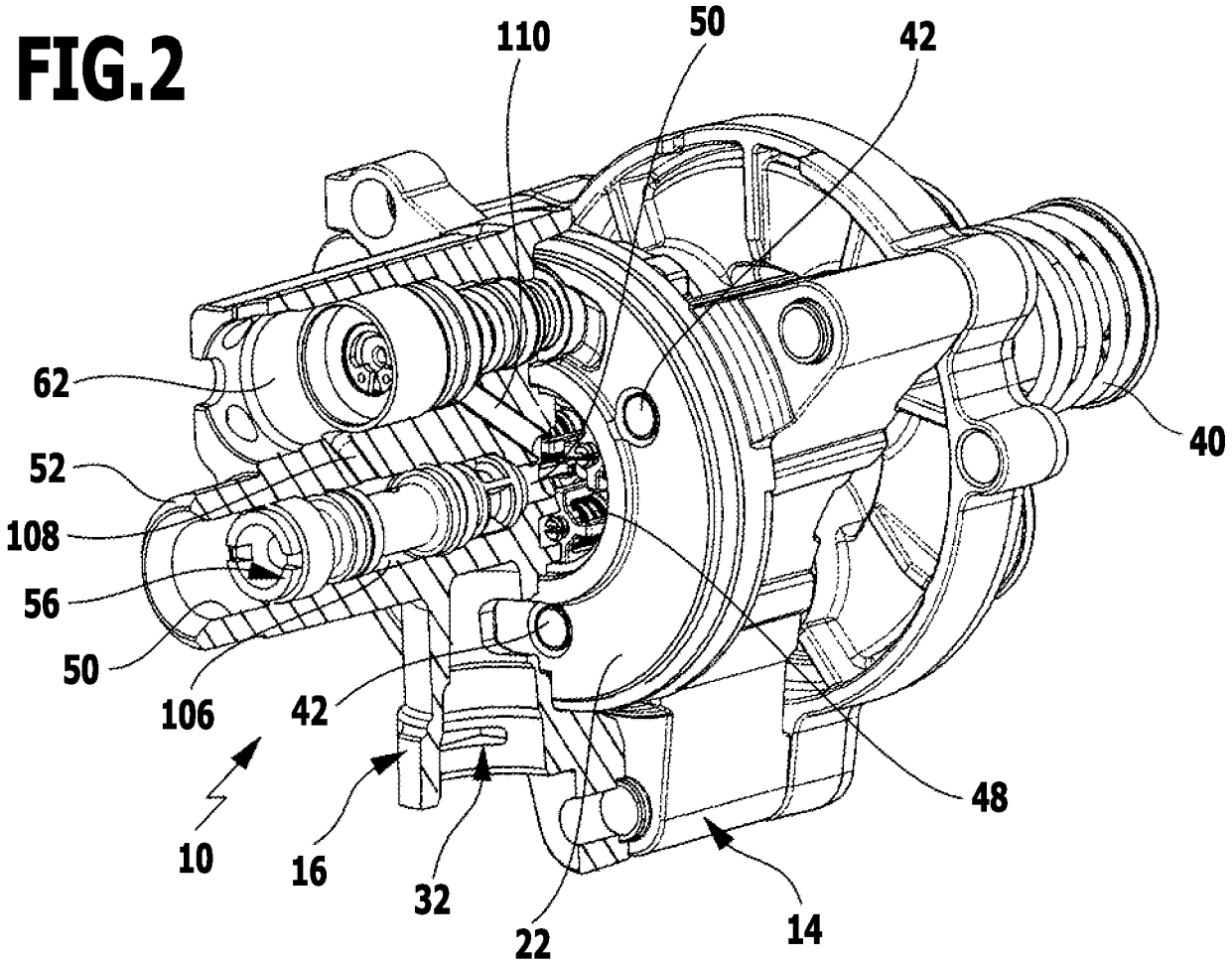
FIG. 2 shows a perspective illustration, partially sectional in a front housing component, of the pump from FIG. 1 at an angle from the front.

As will be particularly clear from FIG. 2, the ring channel 28 and hence the outlet section 30 of the suction line surround both the pressure line 50 and all outlet lines 46 of the individual pump chambers 34 in the circumferential direction. A radially centrally arranged high-pressure section of the joining area between the two housing components 14 and 16 is therefore surrounded by the ring channel and is sealed off from the ring channel by the inner sealing ring 26. The inner sealing ring 26 separates the radially centrally arranged high-pressure section of the joining area from a ring-shaped low-pressure section of the joining area. The low-pressure section surrounds the high-pressure section. It is configured in the form of the ring channel 28 and is sealed off radially on the outside by the outer sealing ring 24.

Via the inlet section 32 and the outlet section 30 of the suction line and the inlet lines 42 adjoining the outlet section 30 in the joining area, the pump chambers 34 can be supplied with cleaning liquid to be delivered. In the pump chambers 34, the cleaning liquid is pressurized due to the oscillating movement of the pistons 36, and the pressurized liquid is supplied to the pressure line 50 via the outlet lines 46.

During normal operation of the pump 10, the pressurized cleaning liquid flows through the injector 56. The latter forms in the pressure line 50 a throttle point at which the cleaning liquid flowing through undergoes a drop in pressure, with the result that the region of the pressure line 50 arranged upstream of the injector 56 has a higher pressure than the region of the pressure line at the level of the transverse bore 60 of the injector 56. So long as there is cleaning liquid flowing through the pressure line 50, the low-pressure chamber 80 connected via the control line 108 to the transverse bore 60 is therefore subjected to a lower pressure than the high-pressure chamber 82 connected via the upper portion 110 of the bypass line to the inlet region of the pressure line 50. This has the consequence that the control piston 78 is displaced in the direction of the sealing plug 64, with the result that the valve body 90 of the overflow valve 72 rests tightly against the valve seat 88 and the flow connection between the pressure line 50 and the outlet section 30 of the suction line is thereby interrupted. The movement of the control piston 78 in the direction of the sealing plug 64 is assisted by a compression spring 116, which surrounds the shaft 94 and rests, on the one hand, against the control piston 78 and, on the other hand, against the valve sleeve 86.

If the flow of cleaning liquid through the pressure line 50 is stopped, for example, by a nozzle head, which is connected via a pressure hose to the pressure line 50, being closed, no dynamic pressure decrease occurs in the region of the constriction of the injector 56. Instead the pressure in this region is the same as the pressure prevailing upstream of the pressure valve 54. In this case, the same pressures prevail in the low-pressure chamber 80 and the high-pressure chamber 82, and in accordance with suitable dimensioning of the effective areas exposed to pressure of the control piston 78, the latter is thereby displaced against the action of the compression spring 116 in the direction facing away from the sealing plug 64. Consequently, the valve body 90 lifts off from the valve seat 88, with the result that the overflow valve 72 opens the flow connection from the pressure line 50 via the portions 70 and 110 of the bypass line to the outlet section 30 of the suction line. The pressure prevailing in the pressure line 50 can thereby be lowered.

The movement of the control piston 78 and the piston rod 92 connected to it also leads to actuation of the switch element 104. The drive of the pump 10 can thereby be switched off. In this way, unnecessary operation of the drive while the nozzle head is closed is avoided.

Operation of the drive is resumed when the nozzle head is opened as cleaning liquid can thereby be discharged via the nozzle head, with the result that a flow of liquid forms in the pressure line 50. This, in turn, leads to a drop in pressure at the injector 56 and hence also in the low-pressure chamber 80 and, consequently, to a movement of the control piston 78 in the direction of the sealing plug 64. Under the action of the pressure relations and under the action of the compression spring 116, the control piston 78 is then displaced in the direction facing the sealing plug again to such an extent that the valve body 90 assumes its closed position in which it rests against the valve seat 88. Owing to the displacement of the control piston 78, the piston rod 92 and with it the plunger 96 are also displaced, with the result that the drive of the pump 10 is switched on again by the switch element 104.

The construction of the outlet section 30 of the suction line in the form of the ring channel 28, which is formed in the rear-side separating surface 20 of the front housing component 16, has the advantage that the cleaning liquid incurs only very low pressure losses in the outlet section 30. Cleaning liquid can therefore be delivered to the pump chambers 34 with low flow losses.

Furthermore, owing to the ring-shaped construction of the outlet section 30, the through-channel 62 forming the control chamber 66 can be positioned practically at any point on the outside of the pressure line 50, with the through-channel 62 being respectively aligned parallel to the pressure line 50. This offers the designer improved creative possibilities, and the manufacturing costs of the pump 10 can be kept low.

Also, manufacture of the outlet section 30 can be carried out relatively easily on the outside of the front housing component 14, namely in the region of the rear-side separating surface 20. This makes a further reduction in the manufacturing costs of the pump 10 possible.

A further advantage of the ring-shaped outlet section 30 is that the lower portion 110 of the bypass line can be kept very short. As a result, the pressure loss which the cleaning liquid incurs in the bypass line can be kept low. This, in turn, has the consequence that the pressure prevailing in the high-pressure chamber 82, in the absence of a flow through the pressure pipe 50, can be reduced within a very short time, and the overflow valve 72 transfers reliably to its open position.

The invention claimed is:

1. Pump for a high-pressure cleaning appliance for delivering a cleaning liquid, comprising:

a pump housing in which is arranged at least one pump chamber into which at least one piston which is movable back and forth plunges, the pump chamber being connected via at least one inlet valve to a suction line and via at least one outlet valve to a pressure line, a bypass line leading from the pressure line to the suction line, and an overflow valve arranged in the bypass line, a valve body of the overflow valve being connected to a control element which in dependence upon a flow rate of the cleaning liquid in the pressure line displaces the valve body to a closed position or an open position, wherein:

the pump housing comprises a rear housing component and a front housing component which are joined together in a joining area, and the suction line comprises a suction line section, a portion of which is arcuately curved and extends in the joining area between the two housing components, the bypass line opens into the suction line section, the control element is configured as a control piston which divides a control chamber of the front housing component into a low-pressure chamber and a high-pressure chamber, the control piston is displaceable in the control chamber and is connected by a piston rod to the valve body of the overflow valve, wherein the piston rod forms on a side of the valve body that faces away from the control piston a plunger for actuating a switch element, the plunger extending through the suction line section.

2. Pump in accordance with claim 1, wherein the arcuately curved portion of the suction line section which extends in the joining area between the two housing components is configured as a self-contained ring.

3. Pump in accordance with claim 1, wherein the arcuately curved portion of the suction line section which extends in the joining area between the two housing components forms an outlet section of the suction line.

4. Pump in accordance with claim 1, wherein the suction line comprises an inlet section arranged in the front housing component, and the arcuately curved portion of the suction line section which extends in the joining area between the two housing components forms an outlet section of the suction line.

5. Pump in accordance with claim 1, wherein the front housing component comprises a rear-side separating surface which is placed on a front-side separating surface of the rear housing component with at least one sealing element interposed between the rear-side separating surface and the front-side separating surface, a channel constituting at least the arcuately curved portion of the suction line section which extends in the joining area between the two housing components being formed in at least one of the separating surfaces.

6. Pump in accordance with claim 5, wherein the channel is formed in the rear-side separating surface of the front housing component and is covered by the front-side separating surface of the rear housing component and constitutes the arcuately curved portion of the suction line section which extends in the joining area between the two housing components.

7. Pump in accordance with claim 1, wherein the arcuately curved portion of the suction line section which extends in the joining area between the two housing components surrounds at least partly the pressure line at a distance therefrom.

8. Pump in accordance with claim 1, wherein:

the low-pressure chamber is connected by a control line downstream of a throttle point to the pressure line, and the high-pressure chamber is connected to the pressure line by a portion of the bypass line that is arranged upstream of the overflow valve.

9. Pump in accordance with claim 8, wherein the valve body is configured as a radial widening of the piston rod.

10. Pump in accordance with claim 8, wherein:

the plunger sinks into a receptacle which is formed in the rear housing component, and the switch element is arranged in the receptacle.

11. Pump in accordance with claim 8, wherein the bypass line comprises a portion which accommodates the overflow valve, opens into the arcuately curved portion of the suction line section which extends in the joining area between the two housing components and is oriented in alignment with the control chamber.

12. Pump in accordance with claim 11, wherein the control chamber and the portion of the bypass line that accommodates the overflow valve are oriented parallel to the pressure line.

13. Pump in accordance with claim 11, wherein the control chamber and the portion of the bypass line that accommodates the overflow valve are arranged in a through-channel which passes through the front housing component from a front side to a rear-side separating surface.

* * * * *